US005356354A

United States Patent [19]

Owens

[11] Patent Number: 5,356,354

[45] Date of Patent: Oct. 18, 1994

[54] SOFT, MODULAR, PLAY EQUIPMENT SYSTEM FOR TODDLERS

[76] Inventor: Kevin W. Owens, P.O. Box 247, New Berlin, Pa. 17855

[21] Appl. No.: 148,892

[22] Filed: Nov. 8, 1993

[51] Int. Cl.[5] ..... A63B 9/00; A63B 17/00

[52] U.S. Cl. ..... 482/35

[58] Field of Search ..... 482/35, 36, 37, 148, 482/51; 434/255, 258, 247; 472/16, 30, 136, 137

[56] References Cited

U.S. PATENT DOCUMENTS

| | | | |
|---|---|---|---|
| 3,737,161 | 6/1923 | Taylor et al. | 482/35 |
| 4,991,834 | 2/1991 | Vaux | 482/35 |
| 5,137,271 | 9/1992 | Frankel | 482/35 |
| 5,167,595 | 12/1992 | Gleeson et al. | 482/78 |
| 5,205,748 | 4/1993 | Petersheim | 482/35 |
| 5,226,864 | 7/1993 | Shoners | 482/148 |

*Primary Examiner*—Stephen R. Crow

[57] ABSTRACT

The disclosure pertains to a system of various parts that are assembled to produce modular play equipment units of a variety of sizes and configurations, all with impact attenuating play surfaces for infant and toddler age children. The pans consist of vertical support posts removably attached by threaded, cam-operated fasteners to frames that contain either play activity elements or hand grips to facilitate passage of a child between segments of finished equipment constructions. Frame pieces support horizontal deck pieces at various levels above the ground plane, as well as shade canopy elements and flags. Posts, certain frames, and decks are made of structural core elements embedded in an impact attenuating molded foam body and other frames are made of a structural core with a removable impact attenuating foam and fabric assembly such that when all parts of the system are assembled as a play equipment unit, exposed surfaces present soft, bumper-like materials to dissipate the potential effects of falls or impacts of children playing in the equipment. In the finished play equipment construction, assembled pans form features for stepping, gripping, climbing, playing, and social interaction intended to encourage the development and advancement of fine motor skills and gross motor skills in children of the intended user age group.

11 Claims, 9 Drawing Sheets

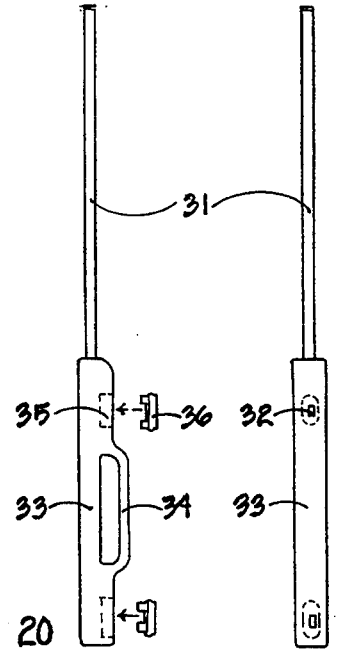
FIG. 20
FIG. 21
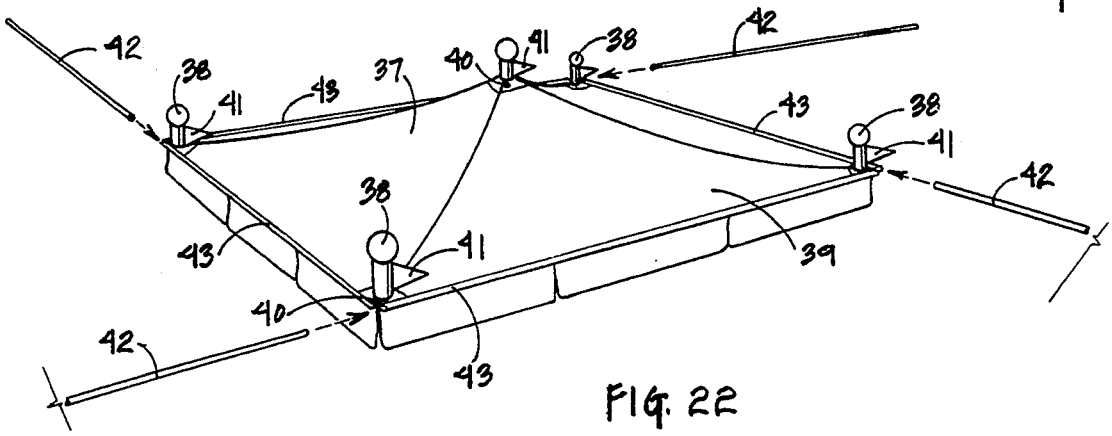
FIG. 22
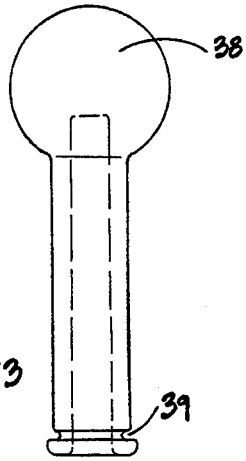
FIG. 23
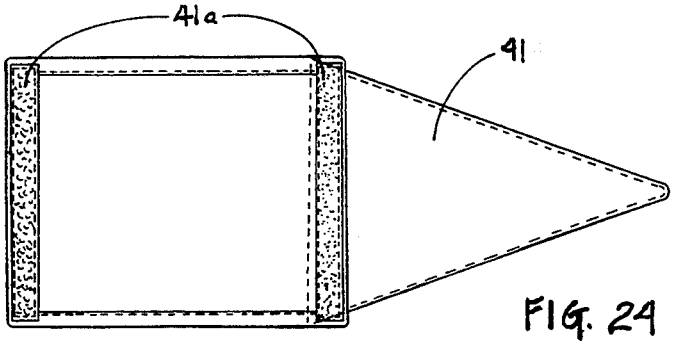
FIG. 24

SOFT, MODULAR, PLAY EQUIPMENT SYSTEM FOR TODDLERS

BACKGROUND OF THE INVENTION

The invention relates to play equipment for infant and toddler age children (8–36 months), and generally in the commercial setting of facilities that accommodate many small children such as daycare centers, preschools, pay-for-play facilities, family entertainment centers, waiting rooms, pediatric hospitals, and the like. Up to this time, the 8–36 month age group has been generally ignored by commercial playground equipment manufacturers. Such manufacturers come from points of view and markets that have caused products to be developed for elementary age children in schoolyard and public park settings, a trend that produced products with proportions, sizes and play events that are not suitable for, and at times have proven quite dangerous to children under 36 months—children who are still acquiring basic skills to maneuver in and manipulate their environs. Further, the substance of commercial playground equipment is typically hard and unforgiving to falls by users, and the assembly of commercial playground equipment typically requires permanent footings and structures of such size as to require significant and costly installation and construction efforts.

In the absence of appropriate equipment, many childcare facilities adapt, with dubious success, equipment designed for larger, more advanced children, often presenting challenges and risks that are not appropriate or safe for toddlers. Products actually intended for this toddler age group are generally toys or very large toys, but nothing comparable in complexity or durability as to be appropriate to commercial play settings such as those previously mentioned.

BRIEF SUMMARY OF THE INVENTION

The invention is a system of various parts that are assembled to produce modular play equipment units of a variety of sizes and configurations, all with impact attenuating play surfaces for infant and toddler age children. The parts consist of vertical support posts removably attached by threaded, cam-operated fasteners to frames that contain either play activity elements or hand grips to facilitate passage of a child between segments of finished equipment constructions. Frame pieces support horizontal deck pieces at various levels above the ground plane, as well as shade canopy elements and flags. Posts, certain frames, and decks are made of structural core elements embedded in an impact attenuating molded foam body and other frames are made of a structural core with a removable impact attenuating foam and fabric assembly such that when all parts of the system are assembled as a play equipment unit, exposed surfaces present soft, bumper-like materials to dissipate the potential effects of falls or impacts of children playing in the equipment. In the finished play equipment construction, assembled parts form features for stepping, gripping, climbing, playing, and social interaction intended to encourage the development and advancement of fine motor skills and gross motor skills in children of the intended user age group.

Among the several objects of the present invention may be noted the provision for a system of parts that make up generally square, in plan, structural bays; the provision of structural bays that make up larger play equipment constructions through sharing of common pans in adjacencies; the provision for safe and appropriate low, soft climbing tiers from the entrance through the entire assembled play unit; play units which, at level changes also provide two cushioned handholds at an appropriate height for the intended user age group; the provision for safe and appropriate features that present opportunities for gross motor skill development and fine motor skill development for children in the intended user age group; the provision for soft, forgiving surfaces throughout the assembled play equipment unit that dissipate the effects of falls and impacts to children who are just learning to ambulate; the provision for full accessibility to children with and without disabilities throughout the assembled play equipment; the provision for durable materials that withstand indoor and outdoor use, cleaning and sanitizing agents, and that are resistant to combustion; the provision for ease of assembly such that one person working alone can assemble the parts of the system to produce a play equipment unit without the use of hand tools, power tools, footings, foundations, and other major constructions, and that this feature is primarily possible through the convenient size and lightness of the parts and the simple connection means used throughout the system, primarily the cam-operated fastener.

These and other objects and features of the present invention will be described and made apparent hereinafter.

BRIEF DESCRIPTION OF THE DRAWINGS

Contained in nine sheets there are 37 figures described as follows:

FIG. 20 is a front view of a pole;

FIG. 21 is a side view of a pole;

FIG. 22 is a perspective view of the shade canopy assembly with its fiberglass reinforced plastic rods shown in exploded form;

FIG. 23 is a side view of a molded cap;

FIG. 24 is a side view of a fabric flag, unrolled;

DETAILED DESCRIPTION OF THE PREFERRED EMBODIMENT

Figure 1:
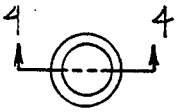
FIG. 1 is a top view of a support post with reference to a sectional view found in FIG. 4.
Figure 2:
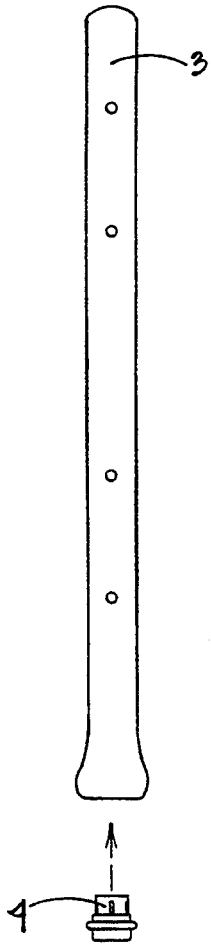
FIG. 2 is an elevation view of a support post showing its molded plastic foot element in exploded form.
Figure 3:
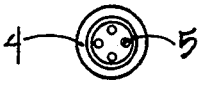
FIG. 3 is a bottom view of a support post including its molded plastic foot element.
Figure 4:
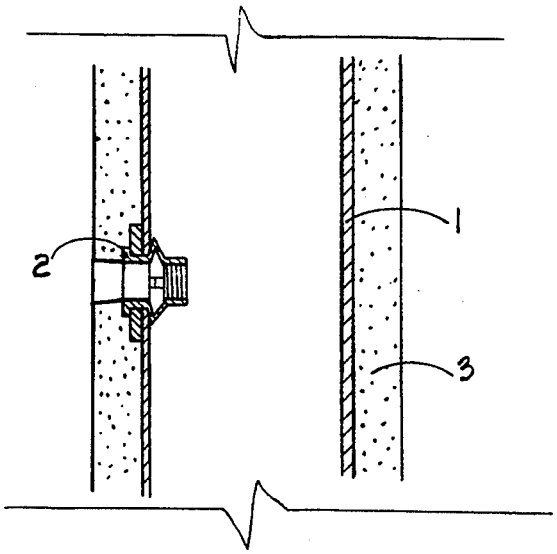
FIG. 4 is an enlarged fragmentary section taken in the plane including line 4—4 of FIG. 1.
Figure 5:
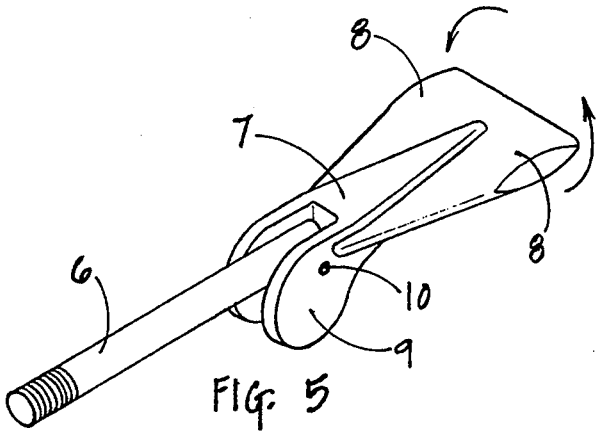
FIG. 5 is an isometric view of a cam-operated fastener with indications of its rotational ability.
Figure 6:
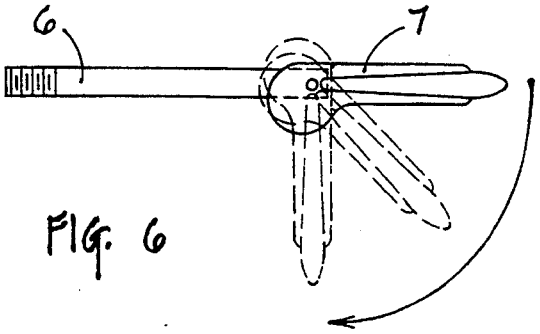
FIG. 6 is a side view of a cam-operated fastener with indications of its folding over and clamping ability.
Figure 7:
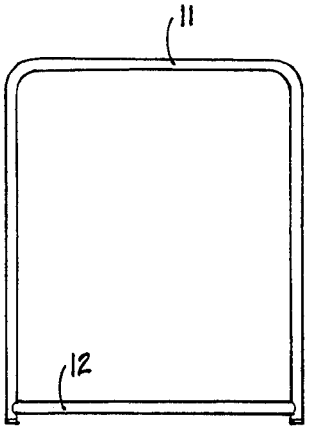
FIG. 7 is a front view of a wall frame.
Figure 8:
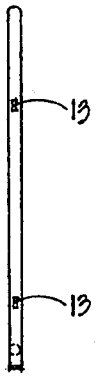
FIG. 8 is a side view of a wall frame.
Figure 9:
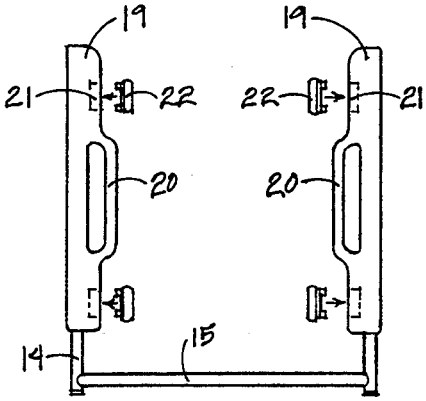
FIG. 9 is a front view of a 'U' frame with one bottom rung.
Figure 10:
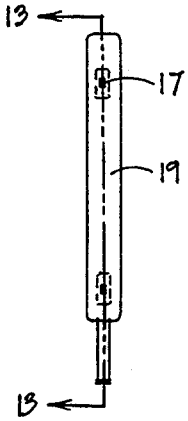
FIG. 10 is a side view of a 'U' frame with one bottom rung with reference to a sectional view found in FIG. 13.
Figure 11:
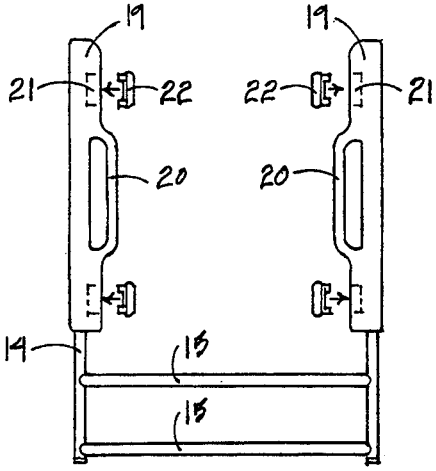
FIG. 11 is a front view of a 'U' frame with two bottom rungs.
Figure 12:
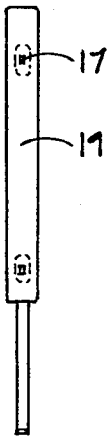
FIG. 12 is a side view of a 'U' frame with two bottom rungs.
Figure 13:
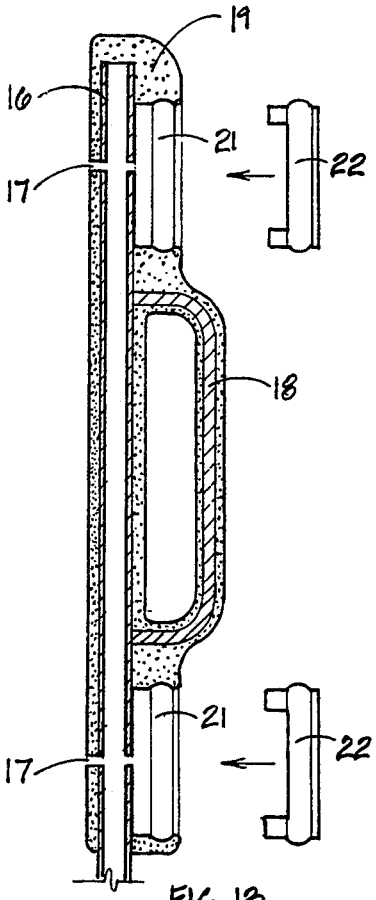
FIG. 13 is an enlarged fragmentary section taken in the plane including line 13—13 of FIG. 10 and is typical of all 'U' and 'J' frames and poles.
Figure 14:
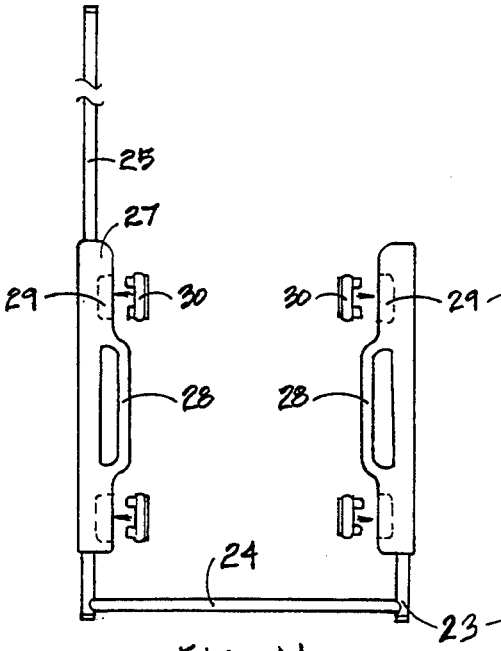
FIG. 14 is a side view of a 'J' frame with one bottom rung.
Figure 15:
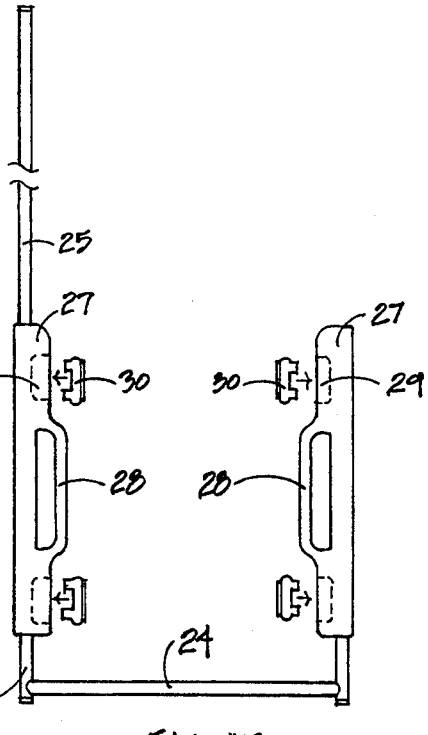
FIG. 15 is a side view of an extra tall 'J' frame with one bottom rung.
Figure 16:
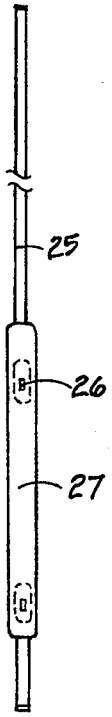
FIG. 16 is an end view of an extra tall 'J' frame with one bottom rung.
Figure 17:
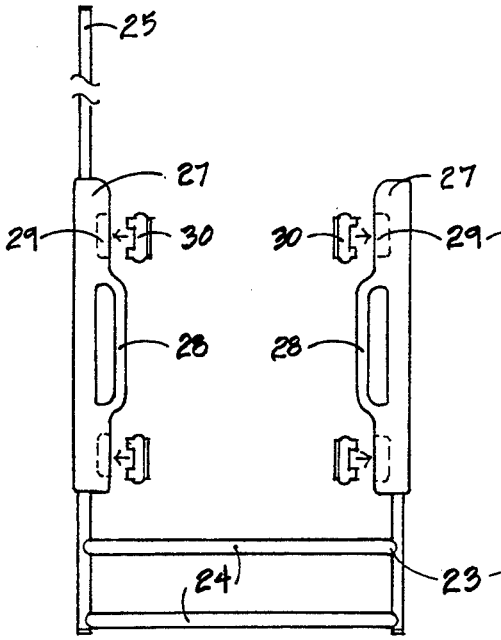
FIG. 17 is a front view of a 'J' frame with two bottom rungs.
Figure 18:
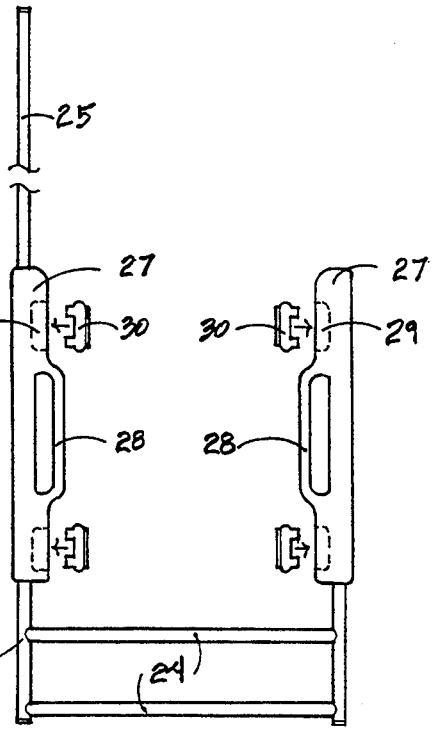
FIG. 18 is a front view of an extra tall 'J' frame with two bottom rungs.
Figure 19:
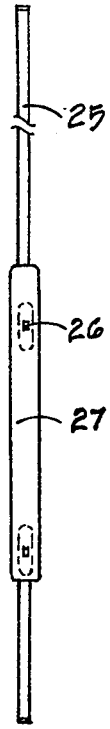
FIG. 19 is a side view of an extra tall 'J' frame with two bottom rungs.
Figure 25:
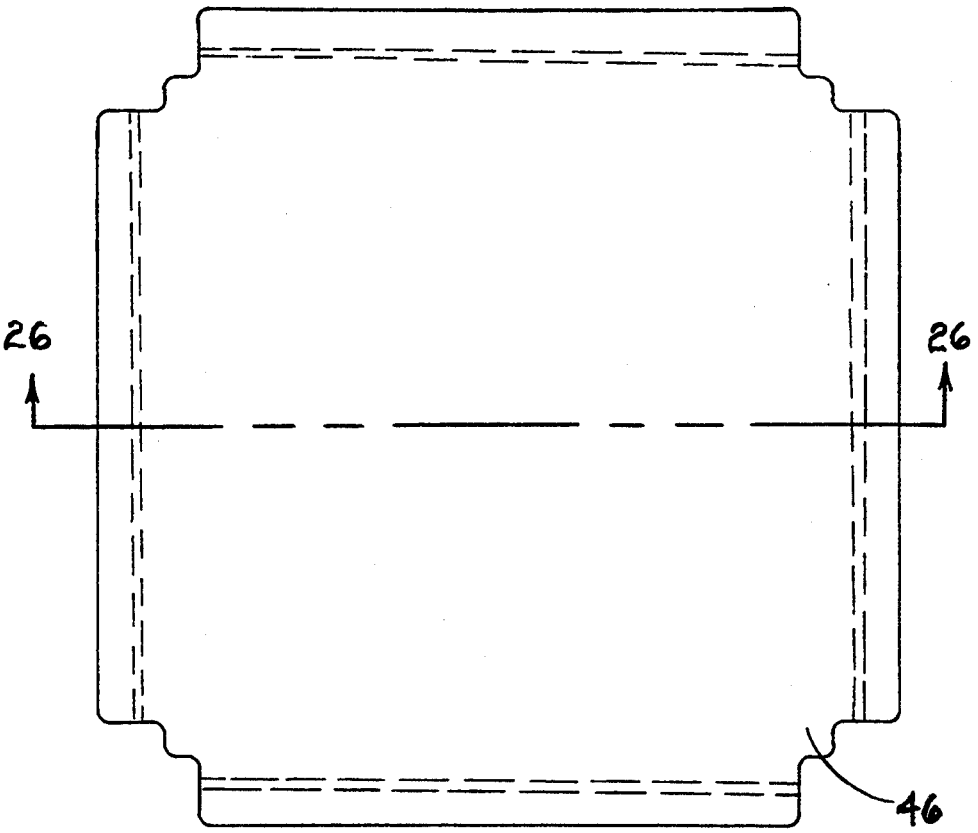
FIG. 25 is a top view of a horizontal deck with reference to a sectional view found in FIG. 26.
Figure 26:
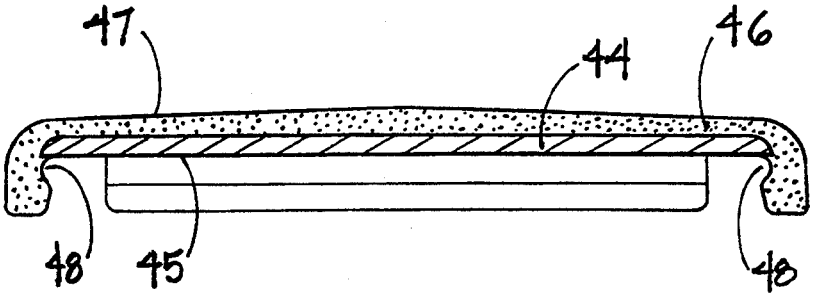
FIG. 26 is a section taken in the plane including line 26—26 of FIG. 25.
Figure 27:
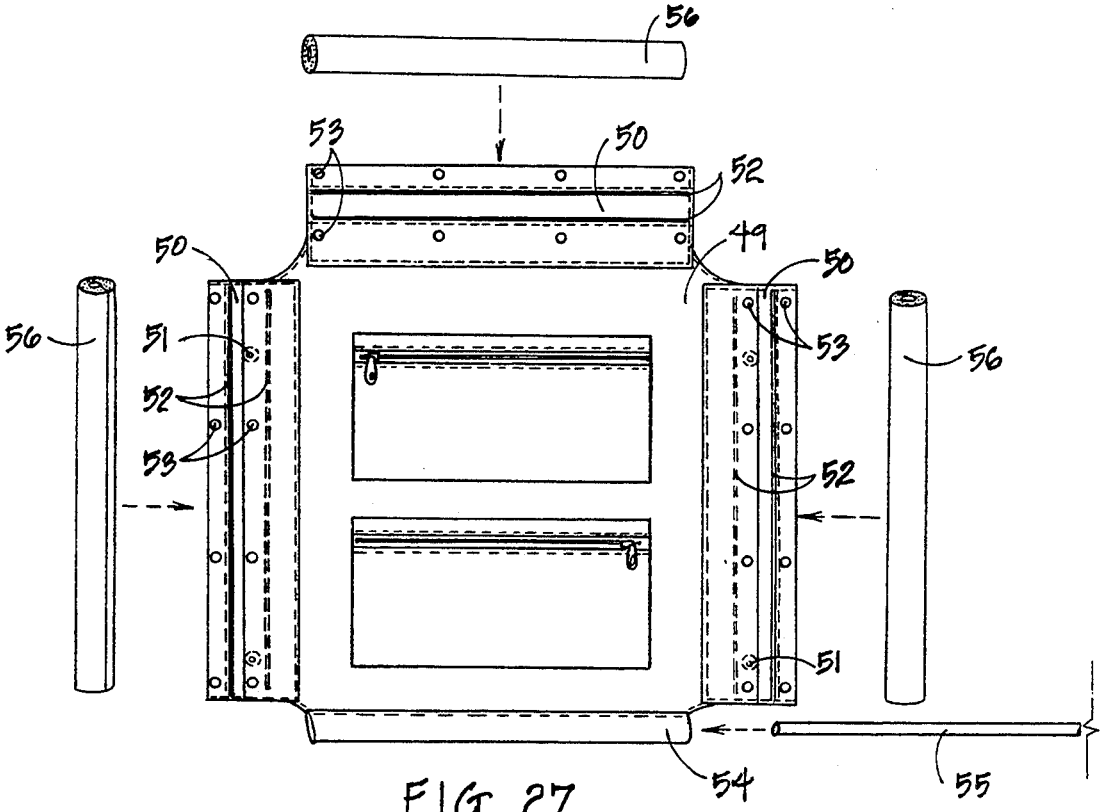
FIG. 27 is a front view of a fabric play and learning activity wall, with flaps flattened, and with its polyethylene foam tubes and fiberglass reinforced plastic rod shown in exploded form; actual activities vary, zipper pockets are shown as examples only.
Figure 28:
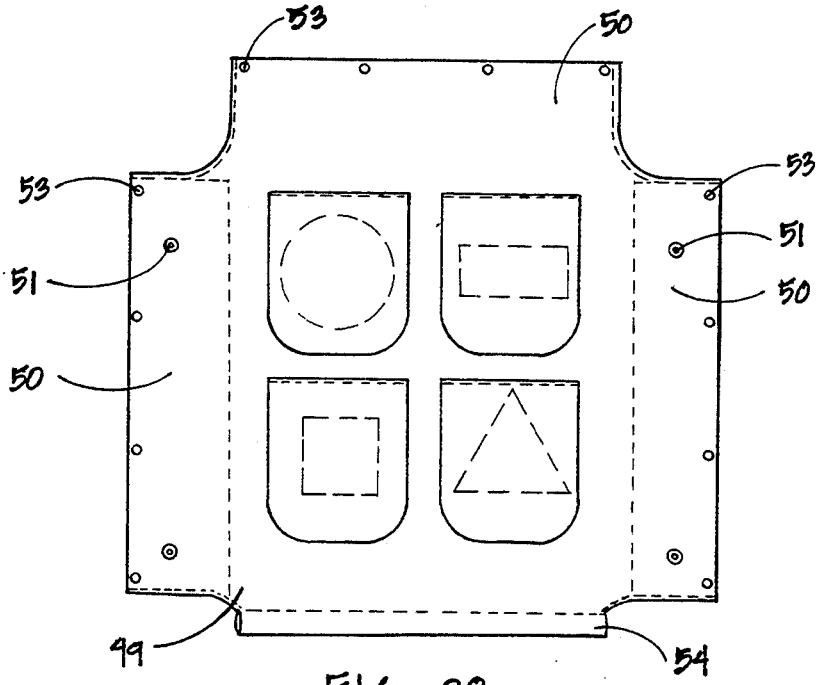
FIG. 28 is a back view of a fabric play and learning activity wall; actual activities vary, shape discovery flaps with noisemakers are shown as examples only.
Figure 29:
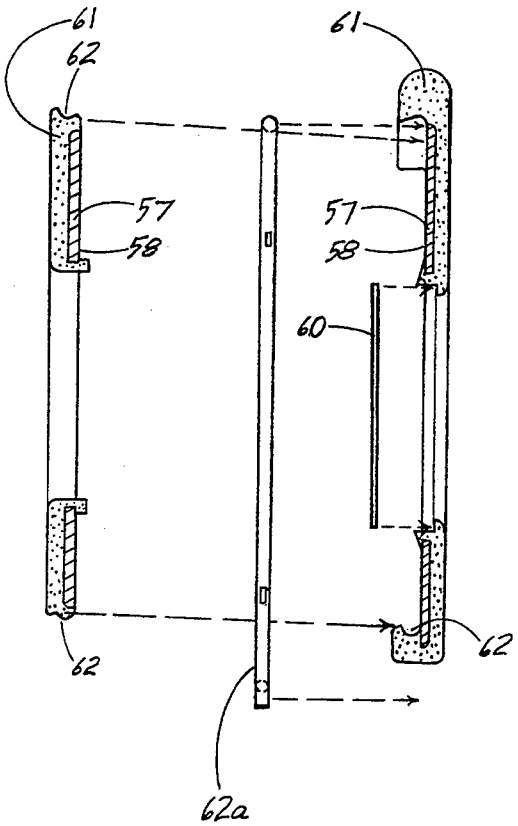
FIG. 29 is an exploded assembly view of the various parts of a foam window or mirror activity wall, made up of a section taken in the plane including line 29—29 of FIG. 31, a section taken in the plane including line 29—29 of FIG. 30, one wall frame, and one side view of a polycarbonate window or mirror.
Figure 30:
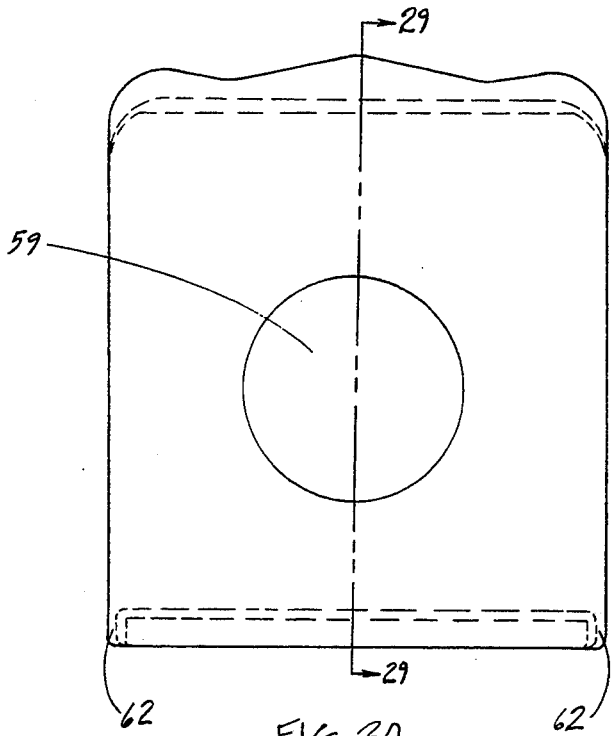
FIG. 30 is a view of the foam side of the first major piece of the foam activity wall with reference to a sectional view found in FIG. 29.
Figure 31:
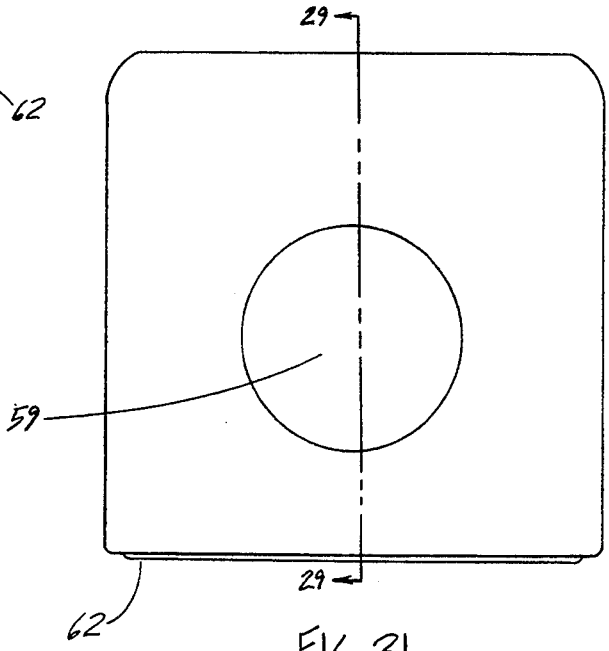
FIG. 31 is a view of the foam side of the second major piece of the foam activity wall with reference to a sectional view found in FIG. 29.
Figure 32:
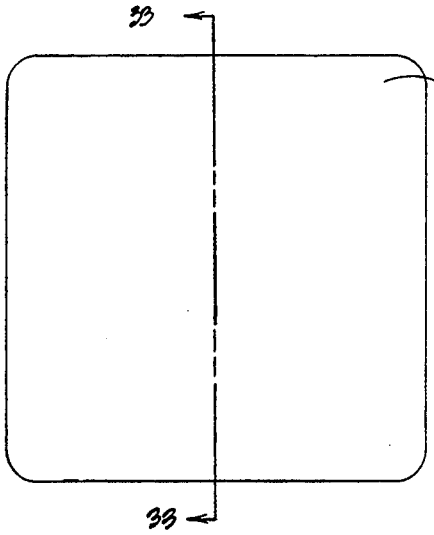
FIG. 32 is a top view of the horizontal floor piece of the pit for the containment of a pool of play balls or other toys with reference to a sectional view found in FIG. 33.
Figure 33:
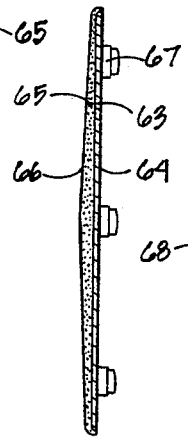
FIG. 33 is a section taken in the plane including line 33—33 of FIG. 32.
Figure 34:
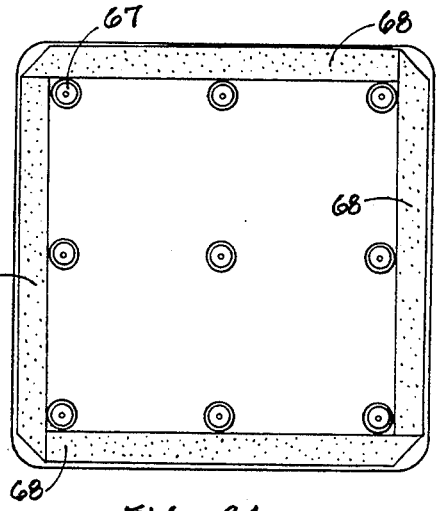
FIG. 34 is a bottom view of the horizontal floor piece of the pit for the containment of a pool of play balls or other toys.
Figure 35:
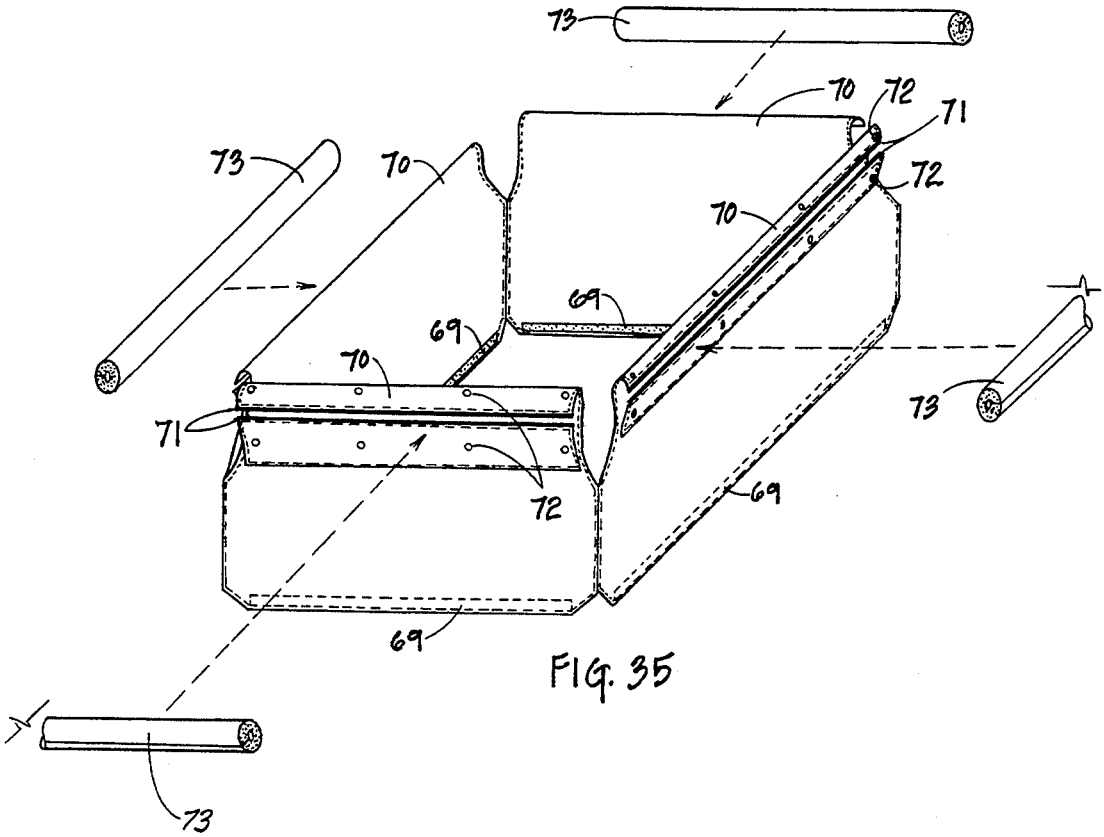
FIG. 35 is an isometric view of the skin assembly of the pit for the containment of a pool of play balls or other toys with its polyethylene foam tubes shown in exploded form.

Referring now to the drawings that depict the present invention, the system of parts (FIGS. 1–35) that can be assembled to produce modular play equipment for infant and toddler age children consists of posts, cam-operated fasteners, wall frames, 'U' frames, 'J' frames, support poles, shade canopies, decks, activity walls, and pits to contain balls or other toys.

Each vertical support post (FIGS. 1–4) consists of a tubular steel structural core 1 containing one or more columns of threaded steel inserts 2 to serve as attachment points for assembly of said system. The steel core is cast into a cylindrical, molded polyurethane foam cushioning body 3 on all sides except the bottom. A molded plastic foot element 4 is permanently plugged into the bottom of the casting and core assembly by means of an interference fit. The foot element carries the vertical support post above ground level for of drainage, and additionally contains drain holes 5 to allow for escape of condensation that may occur inside the structural steel core.

Each cam-operated fastener (FIGS. 5–6) consists of a threaded steel cylinder 6 intended for insertion into the threaded inserts of the vertical support posts, and a molded plastic handle 7. The handle contains two fin-like elements 8 to assist rotational adjustment of the threaded steel element in the threaded insert of the post, and a generally cylindrical hub 9 with an offset connecting cavity 10 for the attachment of the handle to the threaded steel element by means of a steel spring pin, the location of which produces a cam or over-center mechanism which in combination with the threaded steel element allows for both rotational adjustment (FIG. 5) of the fastener in or out and for a fold-over clamping action (FIG. 6) to securely draw together the framing members of the system to the vertical support posts during assembly without the need to use hand tools or power tools or other conventional construction means.

Each wall frame (FIGS. 7–8) consists of a generally rectangular welded assembly of steel tubing 11, the bottom rung 12 of which provides support to the horizontal deck, the portion above the bottom rung of which provides for the application of assemblies of fabric or foam play and learning activity walls and which contains holes 13 for the connection of the frame to a post using the cam-operated fasteners.

Each 'U' frame (FIGS. 9–13) consists of a 'U' shaped welded structural core assembly of steel tubing 14, the bottom rung or rungs 15 of which provide support to the horizontal deck, the portion above the bottom rung or rungs of which consists of two vertical elements 16 containing holes 17 for the connection of the frame to a post with the cam-operated fasteners, to which are welded the structural core portion of handholds 18 to assist children in entrance and passage between decks of the finished play structure, and a pair of molded polyurethane foam cushioning bodies 19 into which said structural core assembly is embedded along the vertical portions of the core, completing two handholds 20 with the proper diameter to allow for maximum grip strength of children in the intended age group and providing a pliable, easy to grip surface, and containing for four pockets 21 that cover and protect the cam-operated fasteners that hold the frame to a post from tampering and cushion such hard elements against falls by users when plugged with four molded polyurethane cushioning bodies 22 that snap fit, in a manner childproof to the intended user age group, into said pockets.

Each 'J' frame (FIGS. 13–19) consists of a 'J' shaped welded structural core assembly of steel tubing 23, the bottom rung or rungs 24 of which provide support to the horizontal deck, the portion above the bottom rung or rungs of which consists of two vertical elements 25, one of which is much taller than the other in order to partially support a shade canopy, both of which contain holes 26 for the connection of the frame to a post with the cam-operated fasteners, to which are welded the structural core portion of handholds 18 (FIG. 13) to assist children in entrance and passage between decks of the finished play structure, a pair of molded polyurethane foam cushioning bodies 27 into which said structural core assembly is embedded along the vertical portions of the core, completing two handholds 28 with the proper diameter to allow for maximum grip strength of children in the intended age group and providing a pliable, easy to grip surface, and containing four pockets 29 that cover and protect the cam operated fasteners that hold the frame to a post from tampering and cushion such hard elements against falls by users when plugged with four molded polyurethane cushioning bodies 30 that snap fit, in a manner childproof to the intended user age group, into said pockets.

Each pole for the support of a portion of a shade canopy (FIGS. 13, 20–21) consists of a straight, vertical welded structural core assembly of steel tubing 31, which contains holes 32 for the connection of the pole to a post with the cam-operated fasteners, to which is welded the structural core portion of a handhold 18 (FIG. 13) to assist children in using activity walls, a molded polyurethane foam cushioning body 33 into which said structural core assembly is embedded, completing the handhold 34 with the proper diameter to allow for maximum grip strength of children in the intended age group and providing a pliable, easy to grip surface, and containing two pockets 35 that cover and protect the cam-operated fasteners from tampering and cushion such hard elements against falls by users when plugged with two molded polyurethane foam cushioning bodies 36 that snap fit, in a manner childproof to the intended user age group, into said pockets.

Each shade canopy (FIGS. 22–24) consists of a four-sided, generally pyramidal canopy 37, sewn of fabric, attached to the upper portion of the taller of the two vertical members of the 'J' frames and to the upper portion of the poles by several generally cylindrical molded polyurethane foam caps 38 that press fit over the upper portion of the 'J' frames and poles and contain an indented ring feature 39 that allows the fabric canopy to attach securely with snaps 40 onto the cap, several triangular fabric flags 41 that each attach by means of hook and loop fastening material 41*a* around one cap to add a visual stimulant to the appearance of the assembled play equipment unit, and four lengths of fiberglass reinforced plastic rod 42 that slide into pockets 43 along the eaves of the pyramidal canopy to provide strength and stiffness for wind resistance.

Each horizontal deck (FIGS. 25–26) consists of a structural core of exterior structural grade plywood 44 with a polyethylene face 45 laminated on one side, a generally square molded polyurethane foam cushioning body 46 sloped away from center for drainage of its top face 47, that forms, along all four sides, a snap fit 48 to attach to the bottom rungs of frames, into which said structural core is embedded on all sides except the bottom, exposing the polyethylene face as a moisture barrier and guard against splinters to exploring children.

Each fabric play and learning activity wall (FIGS. 27–28) consists of a sewn fabric panel 49 containing various play and learning events, three flaps 50 along the top and sides of the panel containing grommets 51, through which pass cam-operated fasteners when attaching wall frames to posts as the first of three redundant checks to ensure the structural reliability of the fabric panel should the following snaps or zippers be tampered with by intended users, zippers 52 that secure the panel on the tubular portion of the wall frame as the second of three redundant checks to ensure the structural reliability of the fabric panel should the following snaps be tampered with by intended users, and snaps 53 that close the flaps by securing them to themselves to provide a third of three redundant checks to ensure the structural reliability of the fabric panel and that are childproof to the intended user age group, a pocket 54 along the bottom of the fabric panel to accept a length of fiberglass reinforced plastic red 55 that flexes into holes in the vertical portions of the wall frame in order to secure the fabric panel along its bottom side, since the bottom rung of the wall frame will be occupied by the snap-on deck when the play unit is assembled, and three lengths of extruded polyethylene foam tubing 56 that wrap the steel tubing of the wall frame along its top side and wrap the steel tubing and cover the camlock handles along the two vertical sides of the wall frame in order to cushion such hard elements against falls by users.

Each foam window or mirror activity wall (FIGS. 29–31) is comprised of two structural cores 57 of exterior structural grade plywood with a polyethylene face 58 laminated on one side, with circular holes 59 to accept window or mirror elements 60, two molded polyurethane foam cushioning bodies 61 that contain snap fit features 62 to attach the window or mirror activity walls to wall frames 62*a*, into which said structural cores are embedded on all sides except the polyethylene faces, and a circular polycarbonate window or mirror 60 to infill the opening in the wall panel.

Figure 36:
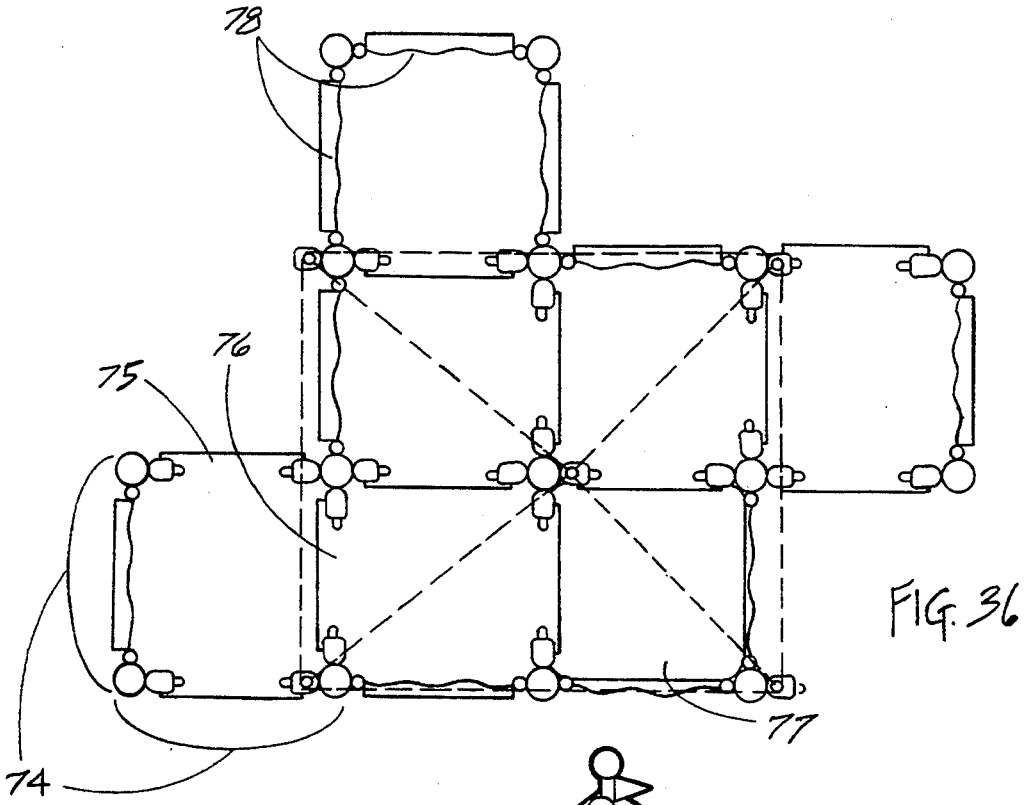
FIG. 36 is a plan view of one example of an assembled modular play equipment unit that can be constructed using the system of pans described herein—infinite configurations are possible.
Figure 37:
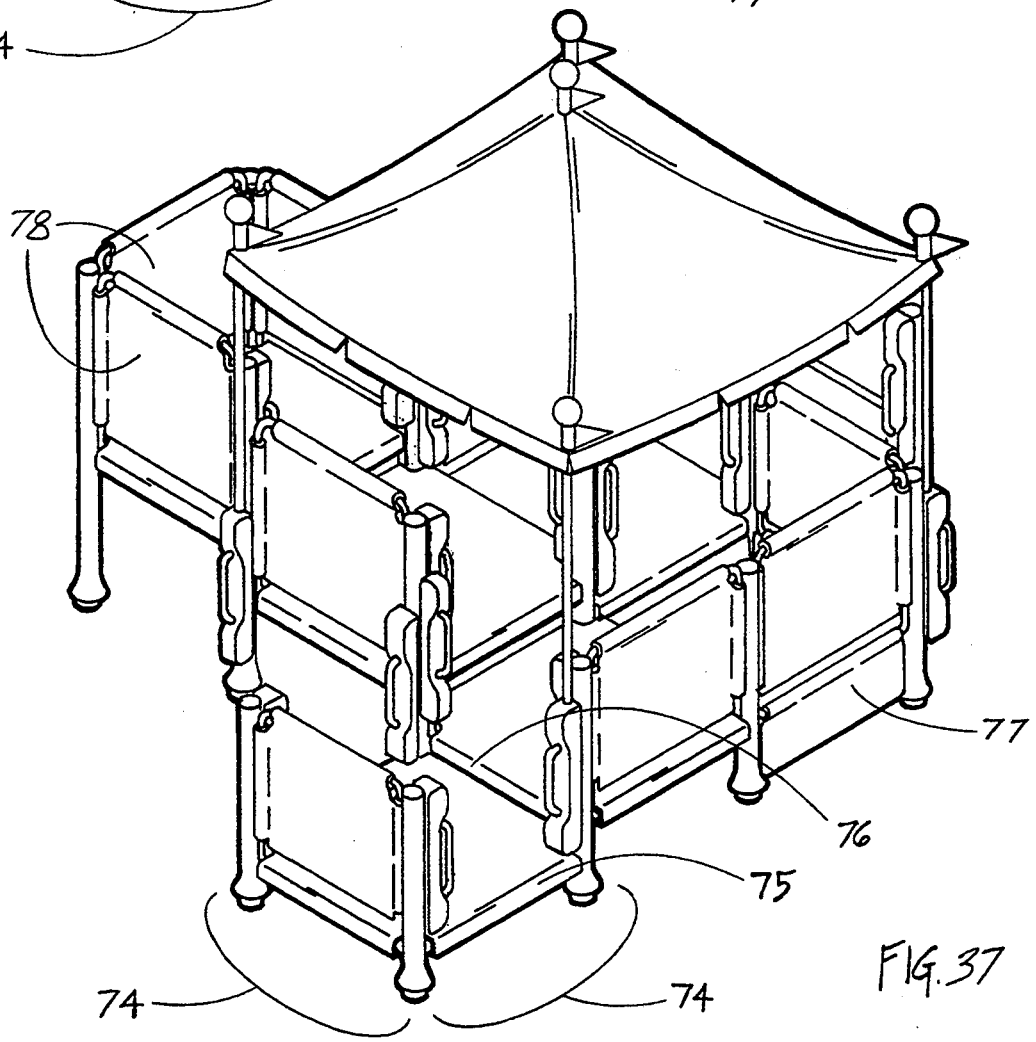
FIG. 37 is an isometric view of the example of an assembled modular play equipment unit found in FIG. 36 that can be constructed using the system of parts described herein—infinite configurations are possible.

Each pit for the containment of a pool of play balls or other toys (FIGS. 32–35) is comprised of a horizontal floor piece (FIGS. 32–34), comprised of a structural core 63 of exterior structural grade plywood with a polyethylene face 64 laminated to one side, a generally square molded polyurethane foam cushioning body 65 with its upper surface sloped away from its center for drainage of its top face 66, into which said structural core is embedded on all sides except the bottom, exposing the polyethylene face as a moisture barrier, a number of plastic foot elements 67 to raise the deck piece above ground level to allow for drainage, and four lengths of hook-and-loop type fastening material 68 adhered to the polyethylene face for the attachment of a skin (FIG. 35) of fabric sewn into the form of a short and generally square tube that contains four lengths of the mating portion of hook-and-loop type fastening material 69 to connect the skirt to the bottom of the horizontal floor piece, four flaps 70 along the top edges of the sides of the square tube each containing, zippers 71 that secure each of four flaps of the skin to the bottom rungs of the various frames of the system when such system is configured into one structural bay 77 (FIGS. 36–37) as the first of two redundant checks to ensure the structural reliability of the sides of the pit should the following snaps be tampered with by intended users, and snaps 72 that close the flaps by securing them to themselves to provide a second of two redundant checks to ensure the structural reliability of the sides of the pit and that are childproof to the intended user age group, and four lengths of extruded polyethylene foam tubing 73 that wrap the bottom rungs of the various frames of the system underneath the skirt flaps to cushion such hard elements against falls by users.

In addition to those specific parts that make up said system and the features of those specific parts, additional features and benefits occur from the assembly of parts of the system to form larger constructions, ultimately an entire play equipment unit.

The assembly of four vertical support posts with four frames of any of the three types of frames named previously, together with their associated threaded cam-operated fasteners, activity walls, and one horizontal deck comprise a generally square, in plan, structural bay 74 (FIGS. 36–37) that is the basis for all modular play equipment units that can be constructed with said system and that in locations between posts wherein a 'U' or 'J' frame is employed in the lowest vertical position on the support posts, an entrance step 75 is thus formed by the overlap of the deck beyond the bottom support rung of said frame, and that said entrance step is of a height differential above the supporting ground plane so as to be an appropriate and safe step height for the anthropometric details of children found to be typical in the intended user age group.

With the addition of sufficient posts, frames, fasteners, activity walls, and decks one can produce additional square structural bays at different heights above the aforementioned entrance level that each share in adjacencies two common posts, one common 'U' or 'J' frame to allow passage between said bays, and four common cam-operated fasteners.

Adjacencies occur between bays wherein the deck of one structural bay will overlap, either above or below, the deck of the adjacent structural bay to form a step 76 (FIGS. 36–37) of height differential from the adjacent deck so as to be an appropriate and safe step height for the anthropometric details of children found to be typical in the intended user age group.

On the assembly of one or more structural bays with at least one entrance step contained in a structural bay with the lowest deck level of said system, thus is produced a play equipment unit (FIGS. 36–37) with generally low stepped tiers that are visible and usable for passage wherever a 'U' or 'J' frame opens a pathway and offers two opposing handgrips for passage, and that this series of soft, low, stepped tiers comprises opportunities for climbing, scrambling, and the like that are safe and appropriate for the gross motor skill development of children in the intended user age group.

The activity walls contained on the wall frames of said unit are usable from both within and without said play equipment unit 78 (FIGS. 36–37) and these various activity walls comprise a variety of opportunities for reaching, grasping, hand-eye coordination, and the like are positioned at a safe and appropriate level and contain safe and appropriate activities for the fine motor skill development of children of the intended user age group.

When fully assembled, this play equipment contains soft and impact attenuating materials, cast polyurethane foam and fabric over extruded polyethylene foam tubing, on all surfaces exposed to play by children of the intended user age group and such surfaces comprise a play environment that is safe and forgiving against impacts by children at an age when they are known to be typically prone to instability and falls as they are beginning to learn how to maneuver themselves in the world.

The play equipment unit with its series of low stepped tiers with handholds comprises features that are accessible to children with disabilities as a result of their dimension, configuration, and proportion, and are particularly safe and appropriate to said children as a result of their impact attenuating surfaces that create a forgiving environment allowing said children to develop and benefit from the gross motor skill and fine motor skill activity events contained throughout the system.

This system of parts when assembled into modular play equipment units comprises a significant improvement over previous commercial play equipment systems that is full accessibility to all play and learning events of said play equipment units to children with disabilities and such accessibility is contained in a system also intended for use by all able-bodied children of the intended user age group, thus producing a true Universal Design and creating the 'mainstreaming' effect advocated by the Americans with Disabilities Act of 1991 (ADA).

This system of parts is comprised of materials, assemblies, coatings, and fabrication techniques that cause those parts to be able to withstand use either indoors or outdoors, to be resistant to combustion, and to be able to withstand sanitizing to meet health requirements using cleaning and sanitizing means typical to child care facilities, including disinfectants, soaps, detergents, chlorine bleaches, and the like.

The assembly of play equipment units from this system of parts can occur through the efforts of one individual, without the employment of hand tools or power tools, earthworks, footings, foundations, and the like, and yet still be stable, firm, and of sufficient substance to withstand the abuses of use by groups of children in the intended user age group. This assembly feature is possible as a result of the lightness and size of the individual pieces that comprise the system and as a result of the strength, adjustability, and ease of use of the cam-operated fastener and snap fit connections used throughout the system.

What is claimed is:

1. A system of various parts that can be assembled in a variety of configurations to produce modular play equipment units for infant and toddler age children (8–36 months), comprised of:

- a number of vertical support posts, each comprised of:
  - a tubular steel structural core containing one or more columns of threaded steel inserts to serve as attachment points for assembly of said system,
  - a cylindrical, molded polyurethane foam cushioning body into which said structural core is embedded on all sides except the bottom, and
  - a molded plastic foot element with drain holes along its bottom surface permanently plugged by means of an interference fit into the cavity exposed in the structural core at the bottom of the molded polyurethane body for the purpose of lifting the vertical support post above ground level to allow for drainage and containing drain holes to allow for escape of condensation that may occur inside the structural steel core;
- a number of threaded cam-operated fasteners, each comprised of:
  - a threaded steel cylinder intended for insertion into the threaded inserts of the vertical support posts, and
  - a molded plastic handle that contains
    - two fin-like elements to assist rotational adjustment of the threaded steel cylinder in the threaded insert of the post, and
    - a generally cylindrical hub with an offset connecting cavity for the attachment of the handle to the threaded steel cylinder by means of a steel spring pin, the location of which produces a cam or over-center mechanism which in combination with the threaded steel cylinder allows for both rotational adjustment of the fastener in or out and for a fold-over clamping action to securely draw together the framing members of the system to the vertical support posts during assembly without the need to use hand tools or power tools or other conventional construction means;

a number of wall frames, each comprised of a generally rectangular welded assembly of steel tubing, the bottom rung of which provides support to the horizontal deck, the portion above the bottom rung of which provides for the application of assemblies of fabric and foam play and learning activity walls and contains holes for the connection of the frame to a post using the cam-operated fasteners;

a number of 'U' frames, each comprised of a 'U' shaped welded structural core assembly of steel tubing, the bottom rung or rungs of which provide support to the horizontal deck, the portion above the bottom rung or rungs of which consists of two vertical elements containing holes for the connection of the frame to a post with the cam-operated fasteners, to which are welded the structural core portion of handholds to assist children in entrance and passage between decks of the finished play structure, a pair of molded polyurethane foam cushioning bodies into which said structural core assembly is embedded along the vertical portions of the core, completing two handholds with the proper diameter to allow for maximum grip strength of children in the intended age group and providing a pliable, easy to grip surface, and providing for four pockets that cover and protect the cam-operated fasteners that hold the frame to a post from tampering and cushion such hard elements against falls by users when plugged with four molded polyurethane cushioning bodies that snap fit, in a manner childproof to the intended user age group, into said pockets;

a number of 'J' frames each comprised of:

a 'J' shaped welded structural core assembly of steel tubing, the bottom rung or rungs of which provide support to the horizontal deck, the portion above the bottom rung or rungs of which consists of two vertical elements, one of which is much taller than the other in order to partially support a shade canopy, both of which contain holes for the connection of the frame to a post with the cam-operated fasteners, to which are welded the structural core portion of handholds to assist children in entrance and passage between decks of the finished play structure, a pair of molded polyurethane foam cushioning bodies into which said structural core assembly is embedded along the vertical portions of the core, completing two handholds with the proper diameter to allow for maximum grip strength of children in the intended age group and providing a pliable, easy to grip surface, and containing four pockets that cover and protect the cam operated fasteners that hold the frame to a post from tampering and cushion such hard elements against falls by users when plugged with four molded polyurethane cushioning bodies that snap fit, in a manner childproof to the intended user age group, into said pockets;

a number of poles for the support of a portion of a shade canopy each comprised of:

a straight, vertical welded structural core assembly of steel tubing, which contains holes for the connection of the pole to a post with the cam-operated fasteners, to which is welded the structural core portion of a handhold to assist children in using activity walls, a molded polyurethane foam cushioning body into which said structural core assembly is embedded, completing the handhold with the proper diameter to allow for maximum grip strength of children in the intended age group and providing a pliable, easy to grip surface, and containing two pockets that cover and protect the cam-operated fasteners from tampering and cushion such hard elements against falls by users when plugged with two molded polyurethane foam cushioning bodies that snap fit, in a manner childproof to the intended user age group, into said pockets;

a shade canopy comprised of:

a four-sided, generally pyramidal canopy, sewn of fabric, attached to the upper portion of the taller of the two vertical members of the 'J' frames and to the upper portion of the poles by several generally cylindrical molded polyurethane foam dips that press fit over the upper portion of the 'J' frames and poles and contain an indented ring feature that allows the fabric canopy to attach securely with snaps onto the cap, several triangular fabric flags that each attach by means of hook and loop fastening material around one cap to add a visual stimulant to the appearance of the assembled play equipment unit, and four lengths of fiberglass reinforced plastic rod that slide into pockets along the caves of the pyramidal canopy to provide strength and stiffness for wind resistance;

a number of horizontal deck pieces, each comprised of a structural core of exterior structural grade plywood with a polyethylene face laminated on one side, a generally square molded polyurethane foam cushioning, body sloped away from center for drainage of its top face, that forms, along all four sides, a snap fit to attach to the bottom rungs of frames, into which said structural core is embedded on all sides except the bottom, exposing the polyethylene face as a moisture barrier and guard against splinters to exploring children;

a number of fabric play and learning activity walls, each comprised of:

a sewn fabric panel containing various play and learning events, three flaps along the top and sides of the panel containing grommets, through which pass cam-operated fasteners when attaching wall frames to posts as the first of three redundant cheeks to ensure the structural reliability of the fabric panel should the following snaps or zippers be tampered with by intended users, zippers that secure the panel on the tubular portion of the wall frame as the second of three redundant checks to ensure the structural reliability of the fabric panel should the following snaps be tampered with by intended users, and snaps that close the flaps by securing them to themselves to provide the third of three redundant checks to ensure the structural reliability of the fabric panel and that are childproof to the intended user age group, a pocket along the bottom of the fabric panel to accept a length of fiberglass reinforced plastic rod that flexes into holes in the vertical portions of the wall frame in order to secure the fabric panel along its bottom side, as the bottom rail of the wall frame will be occupied by the snap-on deck when the play unit is assembled, and three lengths of extruded polyethylene foam tubing that wrap the steel tubing of the wall frame along its top side and wrap the steel tubing and cover the camlock handles along the two vertical sides of the wall frame in order to cushion such hard elements against falls by users;

a number of foam window or mirror activity walls, each comprised of:

two structural cores of exterior structural grade plywood with a polyethylene face laminated on one side, with circular holes to accept window or mirror elements, two molded polyurethane foam cushioning bodies that contain snap fit features to attach the window or mirror activity walls to wall frames, into which said structural cores are embedded on all sides except the polyethylene faces, and a circular polycarbonate window or mirror to infill the opening in the wall panel;

a pit for the containment of a pool of play balls or other toys comprised of:

a horizontal floor piece, comprised of a structural core of exterior structural grade plywood with a polyethylene face laminated to one side, a generally square molded polyurethane foam cushioning body with its upper surface sloped away from its center for drainage of its top face, into which said structural core is embedded on all sides except the bottom, exposing the polyethylene face as a moisture barrier, a number of plastic foot elements to raise the deck piece above ground level to allow for drainage, and four lengths of hook-and-loop type fastening material adhered to the polyethylene face for the attachment of a skirt of fabric sewn into the form of a short and generally square tube containing, four lengths of the mating portion of hook-and-loop type fastening material to connect the skin to the bottom of the horizontal floor piece, four flaps along the top edges of the sides of the square tube each containing, zippers that secure each of four flaps of the skin to the rungs of the various frames of the system when such system is configured into one structural bay as the first of two redundant checks to ensure the structural reliability of the sides of the pit should the following snaps be tampered with by intended users, and snaps that close the flaps by securing them to themselves to provide a second of two redundant checks to ensure the structural reliability of the sides of the pit and that are childproof to the intended user age group, and four lengths of extruded polyethylene foam tubing that wrap the rungs of the various frames of the system underneath the skin flaps to cushion such hard elements against falls by users.

2. A system of parts that produces through assembly, modular play equipment units for infant and toddler age children as set forth in claim 1 wherein the assembly of four vertical support posts with four frames of any of the three types of frames named previously, together with their associated threaded cam-operated fasteners, activity walls, and one horizontal deck comprise a generally square, in plan, structural bay that is the basis for all modular play equipment units that can be constructed with said system and that in locations between posts wherein a 'U' or 'J' frame is employed in the lowest vertical position on the support posts, an entrance step is thus formed by the overlap of the deck beyond the bottom support rung of said frame, and that said entrance step is of a height differential above the supporting ground plane so as to be an appropriate and safe step height for the anthropometric details of children found to be typical in the intended user age group.

3. A square structural bay as set forth in claim 2 wherein with the addition of sufficient posts, frames, fasteners, activity walls, and decks one can produce additional square structural bays at different heights above the aforementioned entrance level that each share in adjacencies two common posts, one common 'U' or 'J' frame to allow passage between said bays, and four common cam-operated fasteners.

4. Adjacent relationships between structural bays as set forth in claim 3 wherein the deck of one structural bay will overlap, either above or below, the deck of the adjacent structural bay to form a step of height differential from the adjacent deck so as to be an appropriate and safe step height for the anthropometric details of children found to be typical in the intended user age group.

5. A series of low stepped tiers formed by adjacencies as set forth in claim 4 wherein on the assembly of one or more structural bays with at least one entrance step contained in a structural bay with the lowest deck level of said system, thus is produced a play equipment unit with generally low stepped tiers that are visible and usable for passage wherever a 'U' or 'J' frame opens a pathway and offers two opposing handgrips for passage, and that this series of soft, low, stepped tiers comprises opportunities for climbing, scrambling, and the like that are safe and appropriate for the gross motor skill development of children in the intended user age group.

6. A play equipment unit as set forth in claim 5 wherein the activity walls contained on the wall frames of said unit are usable from both within and without said play equipment unit and these various activity walls comprise opportunities for reaching, grasping, hand-eye coordination, and the like that are positioned at a safe and appropriate level and contain safe and appropriate activities for the fine motor skill development of children of the intended user age group.

7. A play equipment unit as set forth in claim 5 wherein when fully assembled, this play equipment contains soft and impact attenuating materials, cast polyurethane foam and fabric over extruded polyethylene foam tubing, on all surfaces exposed to play by children of the intended user age group and such surfaces comprise a play environment that is safe and forgiving against impacts by children at an age when they are known to be typically prone to instability and falls as they are beginning to learn how to maneuver themselves in the world.

8. A series of low stepped tiers with handholds as set forth in claim 5 that comprise features that are accessible to children with disabilities as a result of their dimension, configuration, and proportion, and are particularly safe and appropriate to said children as a result of their impact attenuating surfaces that create a forgiving environment allowing said children to develop and benefit from the gross motor skill and fine motor skill activity events contained throughout the system.

9. The accessibility to children with disabilities as set forth in claim 8 such that this system of parts when assembled into modular play equipment units comprises a significant improvement over previous commercial play equipment systems that is full accessibility to all play and learning events of said play equipment units to children with disabilities and such accessibility is contained in a system also intended for use by all able-bodied children of the intended user age group, thus producing a true Universal Design and creating the 'mainstreaming' effect advocated by the Americans with Disabilities Act of 1991 (ADA).

10. A system of pans that produce through assembly, modular play equipment units for infant and toddler age children as set forth in claim 1 wherein each of the said parts is comprised of materials, assemblies, coatings, and fabrication techniques that cause those parts to be able to withstand use either indoors or outdoors, to be resistant to combustion, and to be able to withstand sanitizing to meet health requirements using cleaning and sanitizing means typical to child care facilities, including disinfectants, soaps, detergents, chlorine bleaches, and the like.

11. A system of parts that produce through assembly, modular play equipment units for infant and toddler age children as set forth in claim 1 wherein the assembly of play equipment units from this system of parts can occur through the efforts of one individual, without the employment of hand tools or power tools, earthworks, footings, foundations, and the like, and yet still be stable, firm, and of sufficient substance to withstand the abuses of use by groups of children in the intended user age group, and that this assembly feature is possible as a result of the lightness and size of the individual pieces that comprise the system and as a result of the strength, adjustability, and ease of use of the cam-operated fastener and snap fit connections used throughout the system.

* * * * *

UNITED STATES PATENT AND TRADEMARK OFFICE

CERTIFICATE OF CORRECTION

PATENT NO. : 5,356,354

DATED : October 18, 1994

INVENTOR(S) : Kevin W. Owens

It is certified that error appears in the above-indentified patent and that said Letters Patent is hereby corrected as shown below:

On title page, item [56] "References Cited" "6/1923" should read —6/1973—. and
"Shoners" should read —Showers—

Item [57] Abstract: on lines 5 and 21, "pans" should read —parts—
Column 2, line 1, "pans" should read —parts—
Column 3, line 45, "skin" should read —skirt—
line 51, "pans" should read —parts—
Column 4, line 8, delete "of"
line 53, delete "for"
Column 6, line 10, "red" should read —rod—
lines 46 and 52, "skin" should read —skirt—
Column 7, line 50, before "are" insert —that—
Column 10, line 31, "dips" should read —caps—
line 41, "caves" should read —eaves—
line 50, delete comma after "cushioning"
line 65, "cheeks" should read —checks—
Column 11, line 60, "skin" should read —skirt—
line 65, "skin" should read —skirt—
Column 12, line 12, "skin" should read —skirt—
Column 14, line 4, "pans" should read —parts—

Signed and Sealed this

Eleventh Day of April, 1995

Bruce Lehman

*Attest:*

BRUCE LEHMAN

*Attesting Officer*

*Commissioner of Patents and Trademarks*